US008584765B2

(12) United States Patent
Slup

(10) Patent No.: US 8,584,765 B2
(45) Date of Patent: Nov. 19, 2013

(54) APPARATUS AND METHODS FOR ASSISTING IN SETTING A DOWNHOLE TOOL IN A WELL BORE

(75) Inventor: Gabriel Antoniu Slup, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 224 days.

(21) Appl. No.: 13/215,478

(22) Filed: Aug. 23, 2011

(65) Prior Publication Data

US 2013/0048311 A1 Feb. 28, 2013

(51) Int. Cl.
*E21B 33/00* (2006.01)
*E21B 33/04* (2006.01)
*E21B 33/06* (2006.01)

(52) U.S. Cl.
USPC ..... 166/382; 166/217; 166/212; 166/120

(58) Field of Classification Search
USPC ..... 166/120, 134, 383, 387, 382
See application file for complete search history.

(56) References Cited

U.S. PATENT DOCUMENTS 3,429,375 A * 2/1969 Craig ..... 166/130
4,349,071 A 9/1982 Fish
5,174,379 A * 12/1992 Whiteley et al. ..... 166/278
6,116,339 A 9/2000 Milne et al.

OTHER PUBLICATIONS

Baker Hughes, "Completions and Production Workover Systems", Baker Hughes Product Catalog, 2010, 132 pp.

* cited by examiner

*Primary Examiner* — Jennifer H Gay
*Assistant Examiner* — George Gray
(74) *Attorney, Agent, or Firm* — E. Randall Smith; Jones & Smith, LLP

(57) ABSTRACT

Apparatus for a downhole tool in a well bore includes at least one locking mechanism and at least one sleeve. The locking mechanism is configured in a first position to prevent the upper slips from engaging the well bore wall before being positioned at the desired setting location in the well bore and is moveable into a second position that allows the upper slips to be moved into engagement with the well bore wall. A sleeve is moveable axially in the direction of the lower end of the downhole tool and configured to move the locking mechanism from its first to its second positions and also to move the upper slips axially relative to the downhole tool into engagement with the well bore wall.

20 Claims, 4 Drawing Sheets

APPARATUS AND METHODS FOR ASSISTING IN SETTING A DOWNHOLE TOOL IN A WELL BORE

FIELD OF THE INVENTION

The present disclosure relates generally to the setting of downhole tools in subterranean well bores and, more particularly, to apparatus and methods for assisting in setting a downhole tool in a subterranean well bore.

BACKGROUND OF THE INVENTION

During one or more phases of hydrocarbon recovery operations, it is often desirable or necessary to anchor, or set, a downhole tool in a well bore. A few examples of such downhole tools are bridge plugs and cement retainers. Various devices and techniques are used to assist in setting the downhole tools in the well bore.

Presently known technology for assisting in setting downhole tools in well bores may have one or more drawbacks. For example, some current devices use slip retaining rings to restrict movement of the slips during delivery in the well bore of the downhole tool to the desired setting location. Such devices are designed so that when the setting location is reached, a setting mechanism is actuated to cause the retaining rings to break, releasing the slips so they may be thereafter anchored in the well. However, the slip retaining rings can break prematurely due to contact with debris in the well bore, upon rapid deceleration of the downhole tool or other events. When this occurs, the slips may prematurely move into engagement with the well bore wall.

For another example, some existing systems rely upon gravity to allow the slips to be set in the well bore. Consequently, these devices may be ineffective for use in non-vertical wells, or smooth, or high finish, ID casings, such as expandable casings. For yet another example, many existing devices must be retrofitted to be run via wireline.

It should be understood that the above-described discussion is provided for illustrative purposes only and is not intended to limit the scope or subject matter of the appended claims or those of any related patent application or patent. Thus, none of the appended claims or claims of any related application or patent should be limited by the above discussion or construed to address, include or exclude each or any of the cited examples, features and/or disadvantages, merely because of the mention thereof herein.

Accordingly, there exists a need for improved systems, apparatus and methods useful to assist in setting a downhole tool in a well bore having one or more of the following attributes or capabilities, or one or more of the attribute or capabilities described or shown in, or as may be apparent from, the other portions of this patent: prevents the upper slips of a downhole tool from prematurely engaging the well bore wall; may be employed via mechanical delivery or wireline without retrofitting; allows effective setting of the downhole tool in non-vertical wells; allows for higher downhole tool running-in speeds; reduces the risk of well debris damaging system components or disabling the downhole tool; reduces the force required to actuate the setting mechanism; or any combination thereof.

BRIEF SUMMARY OF THE DISCLOSURE

In some embodiments, the present disclosure involves an apparatus useful for preventing the premature setting of upper slips of a downhole tool in a well bore prior to reaching the desired setting location in the well bore and assisting in setting the upper slips in the well bore. At least one locking mechanism is movable radially inwardly relative to the main body of the downhole tool from at least a first position to at least a second position. In the first position, the locking mechanism is configured to prevent the upper slips from engaging the well bore wall before being positioned at the desired setting location in the well bore. In the second position, the locking mechanism allows the upper slips to be moved into engagement with the well bore wall. A sleeve is axially moveable relative to the main body of the downhole tool in the direction of the lower end of the downhole tool. The sleeve is configured to move the locking mechanism(s) from the first position to the second position as the sleeve moves axially toward the lower end of the downhole tool. The sleeve is also configured to move the upper slips axially relative to the main body of the downhole tool as the sleeve moves axially toward the lower end of the downhole tool to engage the upper slips with the well bore wall.

In many embodiments, a system for assisting in setting a downhole tool in a well bore includes a downhole tool having an elongated mandrel, an upper cone, at least one upper slip and an upper ring. The upper cone extends around the mandrel and includes at least one inclined outer surface. Each upper slip is disposed at least partially between the upper end of the mandrel and the upper cone, axially moveable relative to the mandrel, slideable over one of the inclined outer surfaces of the upper cone and engageable with the well bore wall. The upper ring is disposed on the mandrel at least partially between the upper end of the mandrel and the upper slip(s). The upper ring is axially movable relative to the mandrel and configured to be used to push each upper slip at least partially along the associated inclined outer surface of the upper cone.

In these embodiments, a setting tool is moveable with the downhole tool into the well bore and includes at least one collet assembly and at least one sleeve. The collet assembly is coupled to the mandrel and includes at least one locking mechanism moveable from at least a first to at least a second position. In the first position, the locking mechanism is engaged with the upper ring and prevents the upper ring from advancing the upper slips along the associated inclined outer surfaces of the upper cone. In the second position, the locking mechanism allows the upper ring to be used to push the upper slips along the associated inclined outer surfaces of the upper cone. The sleeve is disposed radially outwardly of the collet assembly and is axially moveable relative to the mandrel and collet assembly. The sleeve is configured to move the locking mechanism(s) from the first to the second positions thereof. The sleeve is also configured to move the upper ring in the direction of the lower end of the mandrel, causing the upper ring to push the upper slip(s) at least partially along the associated inclined outer surface(s) of the upper cone.

In various embodiments, a method of preventing the premature setting of upper slips of a downhole tool in a well bore prior to reaching the desired setting location in the well bore and assisting in setting the upper slips in the well bore with the use of a setting tool includes engaging at least one locking mechanism of the setting tool with the upper slips. The setting tool and downhole tool are deployed in tandem into the well bore. The downhole tool is positioned at the desired setting location. At least one locking mechanism of the setting tool is moved radially inwardly out of engagement with the upper slips. At least one sleeve of the setting tool is moved in the direction of the lower end of the downhole tool to push the upper slips into engagement with the well bore wall.

Accordingly, the present disclosure includes features and advantages which are believed to enable it to advance downhole tool technology. Characteristics and advantages of the present disclosure described above and additional features and benefits will be readily apparent to those skilled in the art upon consideration of the following detailed description of various embodiments and referring to the accompanying drawings.

BRIEF DESCRIPTION OF THE DRAWINGS

The following figures are part of the present specification, included to demonstrate certain aspects of various embodiments of this disclosure and referenced in the detailed description herein.

DETAILED DESCRIPTION OF PREFERRED EMBODIMENTS

Figure 1:
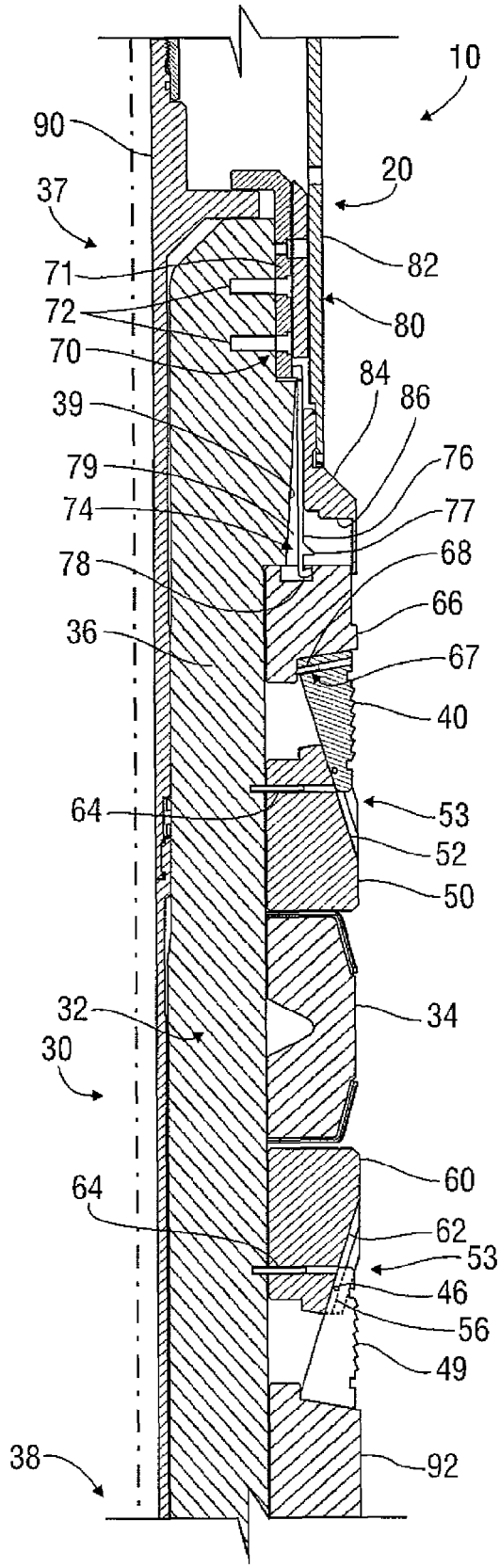
FIG. 1 is a side partial sectional view of an example downhole tool setting system shown in the run-in position in accordance with an embodiment of the present disclosure.

Characteristics and advantages of the present disclosure and additional features and benefits will be readily apparent to those skilled in the art upon consideration of the following detailed description of exemplary embodiments of the present disclosure and referring to the accompanying figures. It should be understood that the description herein and appended drawings, being of example embodiments, are not intended to limit the claims of this patent application, any patent granted hereon or any patent or patent application claiming priority hereto. On the contrary, the intention is to cover all modifications, equivalents and alternatives falling within the spirit and scope of the claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent application, the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims are intended to mean either an indirect or direct connection or engagement. Thus, if a first device couples to a second device, that connection may be through a direct connection, or through an indirect connection via other devices and connections.

Certain terms are used herein and in the appended claims to refer to particular components. As one skilled in the art will appreciate, different persons may refer to a component by different names. This document does not intend to distinguish between components that differ in name but not function. Also, the terms "including" and "comprising" are used herein and in the appended claims in an open-ended fashion, and thus should be interpreted to mean "including, but not limited to . . . . " Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Referring initially to FIG. 1, an example downhole tool setting system 10 is shown. The system 10 includes a setting tool 20 useful to assist in setting or anchoring a downhole tool 30 within an underground well bore (not shown). The tools 20, 30 are designed to be run together inside the well bore and are shown in a run-in position. In the illustrated example, the downhole tool 30 is a composite cement retainer 32 designed to be anchored to a cement casing (not shown) disposed in the well bore (not shown), as is or becomes further known. Another example of a type of downhole tool 30 is a bridge plug. However, the present disclosure in not limited to use in connection with cement retainers and bridge plugs, but can be used with any type of device or combination of devices to be anchored within a well bore. Further, the well bore may have any form, configuration, orientation, internal components and features. For example, the well bore may be a vertical or non-vertical (e.g. horizontal or deviated) open-hole or cased well. Thus, the present disclosure is not limited by the type of downhole tool 30 or well bore and their respective components and features. As used herein, the term "well bore" and variations thereof mean any underground bore or hole having any form, configuration, orientation and internal components suitable to allow a downhole tool 30 to be anchored therein. Further, the term "well bore wall" and variations thereof mean the wall of the well bore or component(s) located therein, such as a casing or lining. As used herein, the term "downhole tool" and variations thereof mean any type of device or combination of devices that can be moved into a well bore and anchored therein.

Still referring to FIG. 1, the illustrated downhole tool 30 includes a packing element 34 and multiple upper and lower slips 40, 49 for engaging the well bore wall. In some configurations, for example, the tool 30 may include twelve upper slips 40 and twelve lower slips 49. The upper and lower slips 40, 49 are configured to be slideably movable along corresponding inclined outer surfaces 52, 62 of respective upper and lower cones 50, 60 into engagement with the well bore wall. The packing element 34 is configured to be compressed between the upper and lower cones 50, 60, so that it expands into engagement with the well bore wall, as is or becomes further known.

The exemplary downhole tool 30 also includes a main body, or elongated mandrel, 36 around which the aforementioned components of the tool 30 are disposed. The upper and lower slips 40, 49 and upper and lower cones 50, 60 are capable of axial movement relative to the mandrel 36. In this example, the upper and lower cones 50, 60 are temporarily coupled to the mandrel 36 with one or more frangible connectors 64, such as, for example, shear pins or bolts. Other than as may be specified below, the downhole tool 30 and related components described above are constructed, configured and operate as is or becomes known in the art. Further, the above-referenced components and the operation thereof are not limiting upon the present disclosure or the appended claims, except and only to the extent as may be specified below. If desired, different or additional components, as are and become known in the art, may be used.

Still referring to FIG. 1, now in accordance with the present disclosure, the downhole tool 30 also includes an upper ring 66 disposed between the upper end 37 of the mandrel 36 and the upper slips 40. The upper ring 66, upper slips 40 and upper cone 50 are sometimes referred to herein collectively as the "slip system." The upper ring 66 may have any suitable form, construction and configuration. In this embodiment, the upper ring 66 extends around the mandrel 36, is axially movable relative to the mandrel 36 and configured to be used to advance, or push, the upper slips 40 in the direction of the lower end 38 of the mandrel 36 at least partially along the corresponding respective inclined outer surface 52 of the upper cone 50. The exemplary upper ring 66 advances the upper slips 40 into a "set" position in engagement with the well bore wall (not shown).

Figure 2:
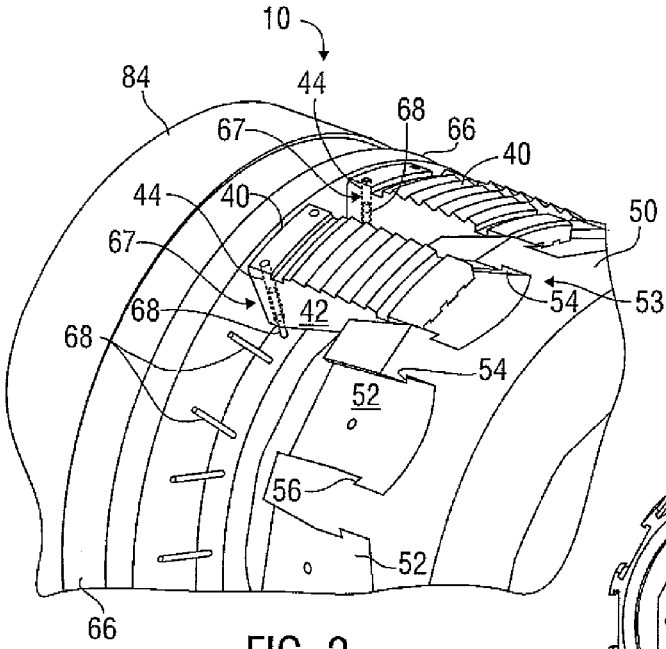
FIG. 2 is a perspective view of a portion of the exemplary slip system of the downhole tool setting system of FIG. 1 in accordance with an embodiment of the present disclosure.

If desired, the upper ring 66 may be at least temporarily engaged, or registered, with the upper slips 40. In at least some applications, this capability may be desirable to ensure the upper slips 40 will move axially only when the upper ring 66 moves, preventing the upper slips 40 from prematurely advancing along the outer included surfaces 52 of the upper cone 50. For example, one or more anchors 67 may be used to at least temporarily maintain the relative axial positions of the upper slips 40 with the upper ring 66. The anchor 67 may have any suitable form, configuration components and operation. In the illustrated example, referring to FIG. 2, the anchor 67 includes one or more slip pins 68 protruding from the upper ring 66 and extending within a slip pin orifice 44 of an upper slip 40. In this example, two pairs of pin 68/orifice 44 combinations are used for each upper slip 40. However, any number of pin 68/orifice 44 combinations may be used for each upper slip 44 when this feature is included.

The exemplary slip pins 68 and slip pin orifices 44 are designed to retain the upper slips 40 in axial alignment with the upper ring 66 prior to and during setting of the upper slips 40. When the upper ring 66 is actuated to push the upper slips 40 along the corresponding inclined outer surfaces 52 of the upper cone 50, the exemplary slip pin orifices 44 will slide freely up the slip pins 68 so that the upper slips 40 can move radially outwardly relative to the upper ring 66 (see e.g. FIG. 7). Thus, the illustrated anchor 67 allows the radial, while restricting the axial, movement of the upper slips 40 relative to the upper ring 66. In this example, once the upper slips 40 sufficiently engage the well bore wall, the slip pin orifices 44 will extend beyond the slip pins 68, allowing the upper ring 66 to separate from the upper slips 40. However, these capabilities and features may not be included in all embodiments.

Figure 3:
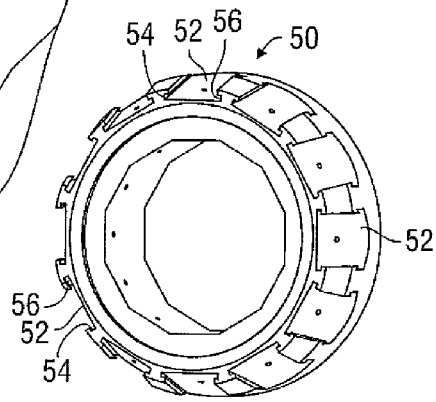
FIG. 3 is a perspective view of the exemplary upper cone of the downhole tool setting system of FIG. 1 in accordance with an embodiment of the present disclosure.
Figure 4:
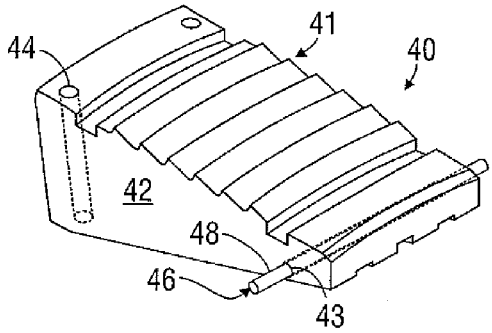
FIG. 4 is a perspective view of an exemplary upper slip of the downhole tool setting system of FIG. 1 in accordance with an embodiment of the present disclosure.

Referring back to FIG. 1, the upper slips 40 may also be engaged with the upper cone 50. In some applications, this capability may be desirable to retain the upper slips 40 in proper radial alignment with the upper cone 50. For example, one or more retainer systems 53 may be used to at least temporarily maintain the relative radial positions of the upper slips 40 and the upper cone 50. The retainer system 53 may have any suitable form, configuration components and operation. In the illustrated example, referring to FIG. 3, the retainer system 53 includes opposing rails, or slots, 54, 56 formed in the upper cone 50 radially outwardly of and along the respective sides of each inclined outer surface 52 and at least one protrusion 46 (e.g. FIG. 8) extending outwardly from the left and right sides 41, 42 of each upper slip 40. The protrusions 46 may have any suitable construction, form and configuration. For example, the illustrated protrusions 46 (e.g. FIG. 8) are metal fingers 47 extending from the slip 40. For another example, such as shown in FIG. 4, the protrusions 46 may be the ends of one or more rods 48 extending through one or more holes 43 formed in the upper slip 40. Each illustrated protrusion 46 is captured and freely slideable within the corresponding adjacent slot 54, 56 of the upper cone 50. The illustrated slots 54, 56 are thus configured to retain the corresponding protrusions 46, maintaining radial alignment of the upper slip 40 with the upper cone 50. In the exemplary downhole tool setting system 10, a similar retainer system 53 is used with each lower slip 49 (e.g. FIG. 1) having slots in the lower cone 60 (e.g. slot 56) and protrusions 46 in the lower slips 49. However, these capabilities and features may not be included in all embodiments.

Figure 9:
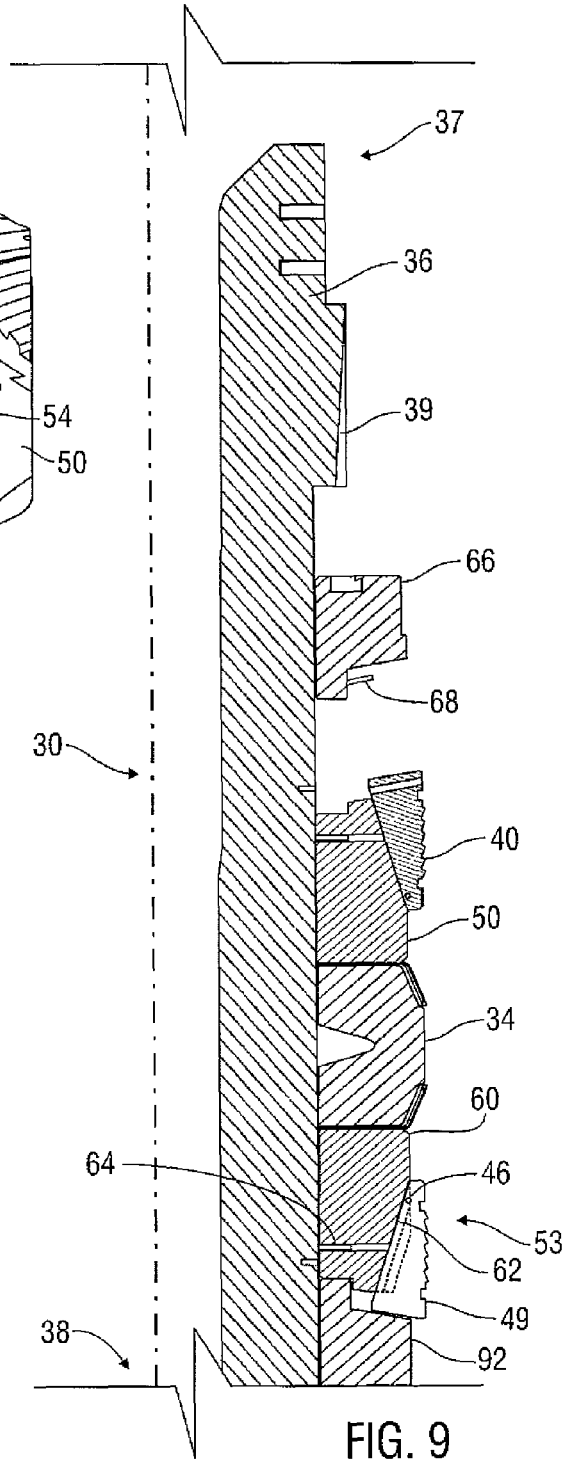
FIG. 9 is a side partial sectional view of the exemplary downhole tool of FIG. 7 shown in the set position and the exemplary setting tool removed in accordance with an embodiment of the present disclosure.

Referring back to FIG. 1, the exemplary setting tool 20 of the present disclosure includes a collet assembly 70 and a sleeve assembly 80. The illustrated collet assembly 70 is coupled to the mandrel 36 and the exemplary sleeve assembly 80 is disposed radially outwardly of the collet assembly 70. In this example, the collet assembly 70 includes a collet body 71 firmly coupled to the mandrel 36 with at least one frangible connector 72, such as one or more shear bolts or pins. The illustrated collet assembly 70 is thus not axially moveable relative to the mandrel 36 during deployment of the system 10. After the downhole tool 30 is fully set in the well bore, the frangible connector(s) 72 of this embodiment may be broken (such as upon the application of sufficient upward pulling force on the setting tool 70 or other suitable technique) to disconnect the setting tool 20 from downhole tool 30 (e.g. FIG. 9).

Still referring to FIG. 1, the collet assembly 70 may have any suitable components, configuration and operation. The illustrated collet assembly 70 includes at least one locking mechanism 74 engageable with the upper ring 66 and capable of restricting the axial movement thereof. The exemplary locking mechanism 74 prevents premature or undesired actuation of the upper ring 66 and upper slips 40 prior to initiating the setting of the slips 40 at the desired location in the well bore. In the illustrated example, the locking mechanism 74 is shown in a first position engaged with the upper ring 66 to effectively hold the upper ring 66 (and upper slips 40) in a generally fixed axial position relative to the mandrel 36, or to at least keep the upper ring 66 from substantial axial movement relative to the mandrel 36. In this position, the locking mechanism 74 prevents the upper ring 66 from being able to push the upper slip(s) 40 along the associated inclined outer surface(s) 52 of the upper cone 50. When it is desired to set the upper slips 40 in the well bore, the illustrated locking mechanism 74 is moveable into a second position (e.g. FIG. 6) that disengages from the upper ring 66, allowing the axial movement of the upper ring 66 relative to the mandrel 36 so that it can be used to advance the upper slip(s) 40 along the inclined outer surfaces 52 of the upper cone 50.

Figure 5:
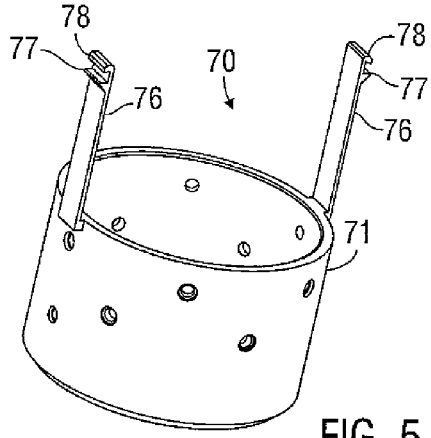
FIG. 5 is a perspective view of the exemplary collet assembly of the downhole tool setting system of FIG. 1 in accordance with an embodiment of the present disclosure.

The locking mechanism 74 may have any suitable form, components, configuration and operation. In the illustrated embodiment, the locking mechanism 74 includes at least one collet finger 76 extending from the collet body 71 and having a control surface 77 and connecting surface 78 extending radially outwardly therefrom (see also FIG. 5). The exemplary collet finger 76 is at least partially moveable radially relative to the collet body 71. The illustrated control surface 77 is engageable by the sleeve assembly 80 and the connecting surface 78 is releasably engaged with the upper ring 66, such as at a lip 69 (e.g. FIG. 6). A gap 79 is located between the collet finger 76 and the mandrel 36 of this embodiment sufficient to allow the collet finger 76 to collapse or be biased radially inwardly sufficient to disengage the connecting surface 78 from the upper ring 66. The gap 79 may be formed, for example, by a slot 39 in the mandrel 36. However, the present disclosure is not limited to this particular arrangement.

Referring again to FIG. 1, the exemplary sleeve assembly 80 is useful to disengage the locking mechanism 74 from the upper ring 66 and actuate the upper ring 66 to move the upper slips 40 along the outer inclines surfaces 52 of the upper cone 50. The sleeve assembly 80 may have any suitable form, components, configuration and operation sufficient to disengage the locking mechanism 74 from the upper ring 66 and actuate the upper ring 66. In this example, the exemplary sleeve assembly 80 is capable of unlocking each locking mechanism 74 from the upper ring 66 by moving it from the first position to the second position. The exemplary sleeve assembly 80 includes a sleeve 82 and a setting nut 84 coupled to the end of the sleeve 82. The setting nut 84 includes an engagement surface 86 designed to engage the upper ring 66 and push it in the direction of the lower end 38 of the mandrel 36. However, a setting nut 84 is not required. Any other suitable component or portion of the sleeve assembly 80 may be used to engage and move the upper ring 66 as desired.

The illustrated sleeve 82 and setting nut 84 are moveable axially relative to the collet assembly 70 and mandrel 36 as is or becomes known. For example, similarly as in presently available mechanical setting tools, the sleeve assembly 80 may be actuated to move the sleeve 82 axially relative to the collet assembly 70 and mandrel 36 in the direction of the lower end 38 of the mandrel 36 by translated rotational movement of a stinger 90. However, any other suitable components and techniques may be used for moving the sleeve 82 and setting nut 84 (if included) axially relative to the collet assembly 70. For example, the sleeve assembly 80 may be hydraulically actuated.

Figure 6:
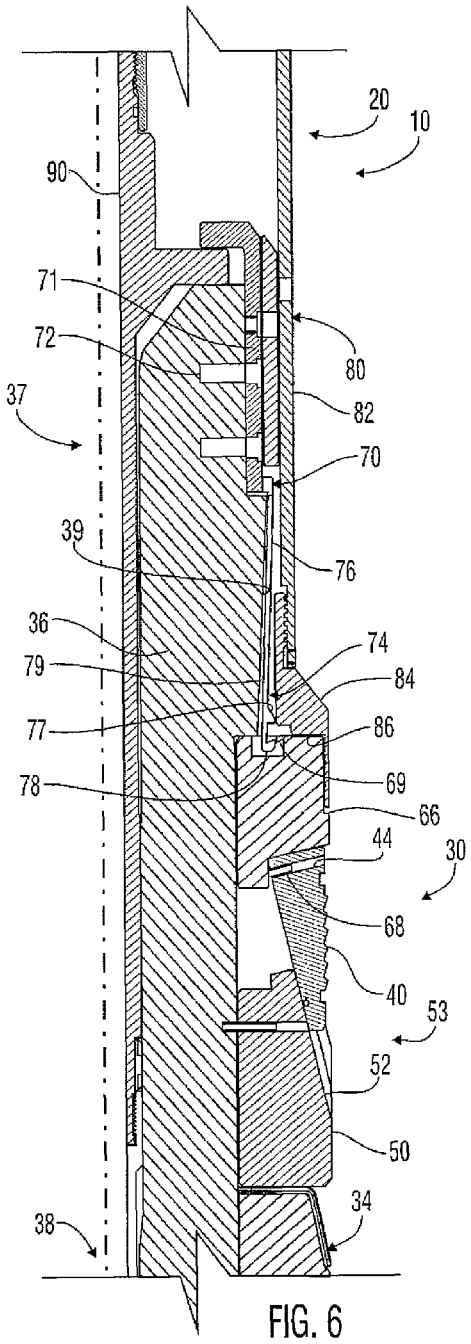
FIG. 6 is a side partial sectional view of the exemplary downhole tool setting system of FIG. 1 shown having the exemplary collet assembly disengaged from the illustrated slip system in accordance with an embodiment of the present disclosure.

In this example, as shown in FIG. 6, the sleeve assembly 80 is configured so that as the sleeve 82 moves axially in the direction of the lower end 38 of the mandrel 36, the setting nut 84 will contact the control surface 77 of each collet finger 76, causing the collet finger 76 to bias or collapse radially inwardly into the gap 79 and disengage each connecting surface 78 from the upper ring 66. The sleeve 80 is configured so that upon further axial movement of the sleeve 82 in the direction of the lower end 38 of the mandrel 36, the exemplary engagement surface 86 of the setting nut 84 will engage the upper ring 66 (e.g. FIG. 7) so that the setting nut 84 can push the upper ring 66 in the direction of the lower end 38 of the mandrel 36 to advance the upper slips 40 along the outer inclined surfaces 52 (e.g. FIG. 8).

An embodiment of a method of operation in accordance with the present disclosure will now be described with reference to FIG. 1. However, neither this embodiment nor other methods of the present disclosure are limited to use with the illustrated components; any suitable components or physical embodiments may be used. Referring to FIG. 1, the illustrated setting tool 20 and downhole tool 30 are coupled together and run into the well bore in tandem mechanically or via wireline. In this example, the collet assembly 70 is releaseably coupled to the mandrel 36 of the downhole tool 30, and the locking mechanism 74 is releasably engaged with the upper ring 66. As described above, the collet finger 76 of the locking mechanism 74 prevents the upper ring 66 from advancing the upper slips 40 to a set position in the well bore.

If desired, the upper slips 40 may be engaged with the upper ring 66 in a manner that ensures the upper slips 40 cannot move axially independent of the upper ring 66. For example, referring to FIG. 2, at least one anchor 67 may include one or more slip pins 68 each protruding from the upper ring 66 and extending within a slip pin orifice 44 of an upper slip 40. The upper slips 40 may also or instead be engaged with the upper cone 50, such as to prevent the upper slips 40 from moving away from the upper cone 50. For example, referring to FIG. 8, one or more retainer systems 53 may include opposing slots 54, 56 formed in the sides of the upper cone 50 and each capturing and providing a path for at least one protrusion 46 extending outwardly from a side of an upper slip 40. Also if desired, the lower slips 49 may similarly be engaged with the lower cone 60, if included. For example, as shown in FIG. 1, one or more retainer systems 53 having opposing slots (e.g. slot 56) formed in the sides of the lower cone 60 may each capture and provide a path for at least one protrusion 46 extending outwardly from a side of a lower slip 49.

Figure 7:
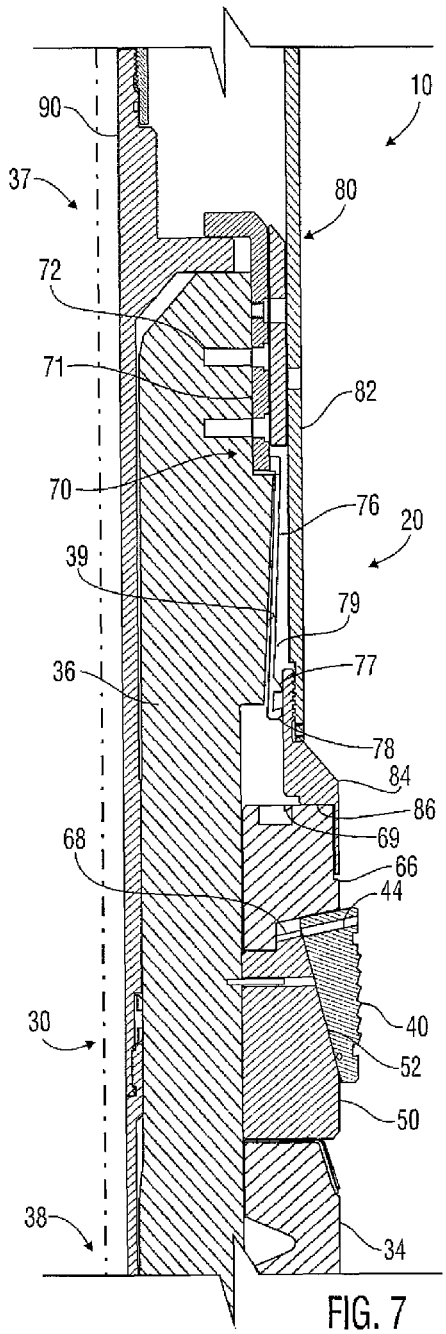
FIG. 7 is a side partial sectional view of the exemplary downhole tool setting system of FIG. 6 shown in a setting position in accordance with an embodiment of the present disclosure.
Figure 8:
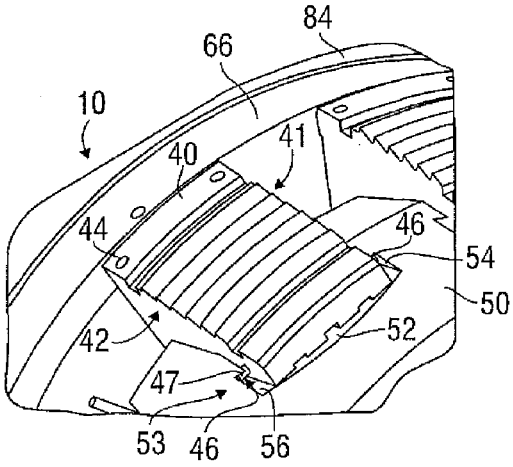
FIG. 8 is a perspective view of a portion of the exemplary slip system of the downhole tool setting system shown in FIG. 7.

In this embodiment, when the desired setting depth in the well bore is reached, the exemplary downhole tool setting system 10 is held in position as the locking mechanism 74 is disengaged from the upper ring 66. For example, as shown in FIG. 6, the exemplary sleeve assembly 80 is actuated to move the sleeve 82 and setting nut 84 (when included) axially in the direction of the lower end 38 of the mandrel 36 relative to the slip system, downhole tool 30 and collet assembly 70. First, the setting nut 84 will bias the control surface 77 of each collet finger 76 into the gap 79, causing each connecting surface 78 to disengage from the upper ring 66. Secondly, as shown in FIG. 7, the exemplary setting nut 84 will engage and push the upper ring 66 in the direction of the lower end 38 of the mandrel 36. The upper ring 66 will, in turn, push the upper slips 40 along the inclined outer surfaces 52 of the upper cone 50 into engagement with the well bore wall (not shown). In this example, as shown in FIG. 8, the upper slips 40 will be guided in the slots 54, 56 formed in the upper cone 50. As the upper slips 40 are pushed by the upper ring 66 along the inclined outer surfaces 52, the upper slips 40 will move radially outwardly relative to the upper ring 66 along the slip pins 68 of the upper ring 66. When the upper slips 40 of this embodiment disengage from the slip pins 68, the upper slips 40 will be set in the well bore.

In this embodiment, once the upper slips 40 are set in the well bore, any suitable technique as is or becomes known may be used to set the lower slips 49 in the well bore and expand the packing element 34 into engagement with the well bore wall to achieve complete pack-off. For example, the mandrel 36 may be pulled upwardly towards surface, causing the lower cap 92 (e.g. FIG. 9, which moves axially with the mandrel 36, to pull the lower slips 49 along the outer inclined surfaces 62 of the lower cone 60 into engagement with the well bore wall. Further upward pulling of the mandrel 36 may cause the packing element 34 to be compressed into engagement with the well bore wall. However, this particular technique may not be included in all embodiments. Moreover, the inclusion, configuration and operation of the lower slips 40 and packing element 34 are not limiting upon the present disclosure or appended claims.

Preferred embodiments of the present disclosure thus offer advantages over the prior art and are well adapted to carry out one or more of the objects of this disclosure. However, the present invention does not require each of the components and acts described above and is in no way limited to the above-described embodiments, methods of operation, variables, values or value ranges. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and claims.

The methods that may be described above or claimed herein and any other methods which may fall within the scope of the appended claims can be performed in any desired suitable order and are not necessarily limited to any sequence described herein or as may be listed in the appended claims. Further, the methods of the present invention do not necessarily require use of the particular embodiments shown and described herein, but are equally applicable with any other suitable structure, form and configuration of components.

While exemplary embodiments of the invention have been shown and described, many variations, modifications and/or changes of the system, apparatus and methods of the present invention, such as in the components, details of construction and operation, arrangement of parts and/or methods of use, are possible, contemplated by the patent applicant(s), within the scope of the appended claims, and may be made and used by one of ordinary skill in the art without departing from the spirit or teachings of the invention and scope of appended claims. Thus, all matter herein set forth or shown in the accompanying drawings should be interpreted as illustrative, and the scope of the disclosure and the appended claims should not be limited to the embodiments described and shown herein.

The invention claimed is:

1. Apparatus useful for preventing the premature setting of upper slips of a downhole tool in a well bore prior to reaching the desired setting location in the well bore and assisting in setting the upper slips in the well bore, the downhole tool having a main body and upper and lower ends, the apparatus comprising:

at least one locking mechanism movable radially inwardly relative to the main body of the downhole tool from at least a first position to at least a second position, said at least one locking mechanism in said first position configured to prevent the upper slips from engaging the well bore wall before being positioned at the desired setting location in the well bore and in said second position, said at least one locking mechanism allowing the upper slips to be moved into engagement with the well bore wall;

a sleeve axially moveable relative to the main body of the downhole tool in the direction of the lower end of the downhole tool and configured to move said at least one locking mechanism from said first position to said second position as said sleeve moves axially toward the lower end of the downhole tool, said sleeve also being configured to move the upper slips axially relative to the main body of the downhole tool as said sleeve moves axially toward the lower end of the downhole tool to engage the upper slips with the well bore wall; and an upper ring disposed around the main body of the downhole tool between said at least one locking mechanism and the upper slips, said upper ring being configured to push the upper slips axially relative to the main body of the downhole tool in the direction of the lower end thereof into engagement with the well bore wall, said at least one locking mechanism including at least one collet finger engaged with said upper ring in said first position of said locking mechanism and disengaged from said upper ring in said second position of said locking mechanism, wherein said sleeve is configured to bias said at least one collet finger radially inwardly to disengage said collet finger from said upper ring as said sleeve moves axially toward the lower end of the downhole tool.

2. The apparatus of claim 1 wherein said sleeve is disposed radially outwardly of said collet finger.

3. The apparatus of claim 1 wherein said upper ring is at least temporarily engaged with the upper slips.

4. The apparatus of claim 1 further including an upper cone extending around the main body of the downhole tool between the upper slips and the lower end of the downhole tool, said upper cone having a plurality of inclined outer surfaces over which the upper slips are slideable, wherein each said inclined outer surface of said upper cone and each upper slip have respective corresponding left and right sides, further wherein said upper cone includes a slot extending radially outwardly of and along each side of each said inclined outer surface and each upper slip includes at least one protrusion extending outwardly from its respective left and right sides, each said protrusion being captured and slideable within a corresponding said slot of said upper cone, wherein said slots are configured to retain said corresponding protrusions during movement of each upper slip relative to said upper cone.

5. Apparatus useful for preventing the premature setting of upper slips of a downhole tool in a well bore prior to reaching the desired setting location in the well bore and assisting in setting the upper slips in the well bore, the downhole tool having a main body and upper and lower ends, the apparatus comprising:

at least one locking mechanism movable radially inwardly relative to the main body of the downhole tool from at least a first position to at least a second position, said at least one locking mechanism in said first position configured to prevent the upper slips from engaging the well bore wall before being positioned at the desired setting location in the well bore and in said second position, said at least one locking mechanism allowing the upper slips to be moved into engagement with the well bore wall;

a sleeve axially moveable relative to the main body of the downhole tool in the direction of the lower end of the downhole tool and configured to move said at least one locking mechanism from said first position to said second position as said sleeve moves axially toward the lower end of the downhole tool, said sleeve also being configured to move the upper slips axially relative to the main body of the downhole tool as said sleeve moves axially toward the lower end of the downhole tool to engage the upper slips with the well bore wall; and an upper ring disposed around the main body of the downhole tool between said at least one locking mechanism and the upper slips, said upper ring being configured to push the upper slips axially relative to the main body of the downhole tool in the direction of the lower end thereof into engagement with the well bore wall, said at least one locking mechanism including at least one collet finger engaged with said upper ring in said first position of said locking mechanism and disengaged from said upper ring in said second position of said locking mechanism, wherein said upper ring is at least temporarily engaged with the upper slips and includes a plurality of slip pins each engaged within one among a plurality of slip pin orifices formed in the upper slips and configured to prevent axial movement of the upper slips relative to said upper ring, the upper slips being configured to move radially outwardly relative to said upper ring over said slip pins as the upper slips are moved axially relative to the main body of the downhole tool.

6. System for assisting in setting a downhole tool in a well bore, the system comprising:

the downhole tool including an elongated mandrel having upper and lower ends, an upper cone extending around said mandrel and having at least one inclined outer surface, at least one upper slip disposed at least partially between the upper end of said mandrel and said upper cone, said at least one upper slip being axially moveable relative to said mandrel, slideable over one of said inclined outer surfaces of said upper cone and engageable with the well bore wall, an upper ring disposed on said mandrel at least partially between the upper end of said mandrel and said at least one upper slip, said upper ring being axially movable relative to said mandrel and configured to be used to push at least one said upper slip at least partially along said associated inclined outer surface of said upper cone; and a setting tool being moveable with the downhole tool into the well bore and including at least one collet assembly coupled to said mandrel, said collet assembly including at least one locking mechanism engaged with said upper ring in a first position to prevent said upper ring from advancing said at least one upper slip along said associated inclined outer surface of said upper cone, said at least one locking mechanism being moveable from said first position into a second position that allows said upper ring to be used to push said at least one upper slip along said associated inclined outer surface of said upper cone, and at least one sleeve disposed radially outwardly of said collet assembly and being axially moveable relative to said mandrel and said collet assembly, said at least one sleeve being configured to move said at least one locking mechanism from said first position to said second position, said at least one sleeve also configured to move said upper ring in the direction of the lower end of said mandrel, causing said upper ring to push said at least one upper slip at least partially along said associated inclined outer surface of said upper cone, wherein said collet assembly is releasably coupled to said mandrel with at least one frangible connector, said at least one frangible connector being configured to allow said collet assembly to be released from said mandrel upon sufficient upward axial pulling force on said collet assembly, and wherein said setting tool is disengageable from the downhole tool.

7. The system of claim 6 wherein said upper ring is at least temporarily engaged with at least one said upper slip in a manner that prevents axial movement of said at least one upper slip independent of axial movement of said upper ring prior to engagement of said at least one upper slip with the well bore wall.

8. The system of claim 6 wherein at least one said upper slip is engaged with said upper cone in a manner that prevents said at least one upper slip from moving away from said upper cone.

9. The system of claim 8 wherein each said inclined outer surface of said upper cone and each said upper slip have respective corresponding left and right sides, further wherein said upper cone includes a slot extending radially outwardly of and along each side of each said inclined outer surface and each said upper slip includes at least one protrusion extending outwardly from its respective left and right sides, each said protrusion being captured and slideable within a corresponding said slot of said upper cone, wherein said slots are configured to retain said corresponding protrusions during and after movement of each said upper slip relative to said upper cone.

10. The system of claim 6 wherein the downhole tool further includes at least one lower cone extending around said mandrel and having at least one inclined outer surface, the downhole tool also including at least one lower slip disposed at least partially between the lower end of said mandrel and said lower cone, said at least one lower slip being axially moveable relative to said mandrel, slideable over one of said inclined outer surfaces of said lower cone and engageable with the well bore wall, wherein each said inclined outer surface of said lower cone and each said lower slip have respective corresponding left and right sides, further wherein said lower cone includes a slot extending radially outwardly of and along each side of each said inclined outer surface and each said lower slip includes at least one protrusion extending outwardly from its respective left and right sides, each said protrusion being captured and slideable within a corresponding said slot of said lower cone, wherein said slots are configured to retain said corresponding protrusions during and after movement of each said lower slip relative to said upper cone.

11. System for assisting in setting a downhole tool in a well bore, the system comprising:

the downhole tool including an elongated mandrel having upper and lower ends, an upper cone extending around said mandrel and having at least one inclined outer surface, at least one upper slip disposed at least partially between the upper end of said mandrel and said upper cone, said at least one upper slip being axially moveable relative to said mandrel, slideable over one of said inclined outer surfaces of said upper cone and engageable with the well bore wall, an upper ring disposed on said mandrel at least partially between the upper end of said mandrel and said at least one upper slip, said upper ring being axially movable relative to said mandrel and configured to be used to push at least one said upper slip at least partially along said associated inclined outer surface of said upper cone; and a setting tool being moveable with the downhole tool into the well bore and including at least one collet assembly coupled to said mandrel, said collet assembly including at least one locking mechanism engaged with said upper ring in a first position to prevent said upper ring from advancing said at least one upper slip along said associated inclined outer surface of said upper cone, said at least one locking mechanism being moveable from said first position into a second position that allows said upper ring to be used to push said at least one upper slip along said associated inclined outer surface of said upper cone, and at least one sleeve disposed radially outwardly of said collet assembly and being axially moveable relative to said mandrel and said collet assembly, said at least one sleeve being configured to move said at least one locking mechanism from said first position to said second position, said at least one sleeve also configured to move said upper ring in the direction of the lower end of said mandrel, causing said upper ring to push said at least one upper slip at least partially along said associated inclined outer surface of said upper cone, wherein said collet assembly includes at least one collet finger having a control surface and a connecting surface extending radially outwardly therefrom, said control surface being disposed between the upper end of said mandrel and said connecting surface, and said connecting surface being releasably engageable with said upper ring, wherein said at least one sleeve is configured to contact said control surface to bias said collet finger radially inwardly, causing said connecting surface to disengage from said upper ring as said at least one sleeve is moved axially in the direction of the lower end of said mandrel.

12. System for assisting in setting a downhole tool in a well bore, the system comprising:

the downhole tool including an elongated mandrel having upper and lower ends, an upper cone extending around said mandrel and having at least one inclined outer surface, at least one upper slip disposed at least partially between the upper end of said mandrel and said upper cone, said at least one upper slip being axially moveable relative to said mandrel, slideable over one of said inclined outer surfaces of said upper cone and engageable with the well bore wall, an upper ring disposed on said mandrel at least partially between the upper end of said mandrel and said at least one upper slip, said upper ring being axially movable relative to said mandrel and configured to be used to push at least one said upper slip at least partially along said associated inclined outer surface of said upper cone; and a setting tool being moveable with the downhole tool into the well bore and including at least one collet assembly coupled to said mandrel, said collet assembly including at least one locking mechanism engaged with said upper ring in a first position to prevent said upper ring from advancing said at least one upper slip along said associated inclined outer surface of said upper cone, said at least one locking mechanism being moveable from said first position into a second position that allows said upper ring to be used to push said at least one upper slip along said associated inclined outer surface of said upper cone, at least one sleeve disposed radially outwardly of said collet assembly and being axially moveable relative to said mandrel and said collet assembly, said at least one sleeve being configured to move said at least one locking mechanism from said first position to said second position, said at least one sleeve also configured to move said upper ring in the direction of the lower end of said mandrel, causing said upper ring to push said at least one upper slip at least partially along said associated inclined outer surface of said upper cone, and a setting nut coupled to the end of each said sleeve, said setting nut including at least one engagement surface, said engagement surface being engageable with said upper ring and configured to push said upper ring toward the lower end of said mandrel.

13. The system of claim 12 wherein said upper ring is at least temporarily engaged with at least one said upper slip in a manner that prevents axial movement of said at least one upper slip independent of axial movement of said upper ring prior to engagement of said at least one upper slip with the well bore wall.

14. The system of claim 12 wherein at least one said upper slip is engaged with said upper cone in a manner that prevents said at least one upper slip from moving away from said upper cone.

15. The system of claim 14 wherein each said inclined outer surface of said upper cone and each said upper slip have respective corresponding left and right sides, further wherein said upper cone includes a slot extending radially outwardly of and along each side of each said inclined outer surface and each said upper slip includes at least one protrusion extending outwardly from its respective left and right sides, each said protrusion being captured and slideable within a corresponding said slot of said upper cone, wherein said slots are configured to retain said corresponding protrusions during and after movement of each said upper slip relative to said upper cone.

16. The system of claim 12 wherein the downhole tool further includes at least one lower cone extending around said mandrel and having at least one inclined outer surface, the downhole tool also including at least one lower slip disposed at least partially between the lower end of said mandrel and said lower cone, said at least one lower slip being axially moveable relative to said mandrel, slideable over one of said inclined outer surfaces of said lower cone and engageable with the well bore wall, wherein each said inclined outer surface of said lower cone and each said lower slip have respective corresponding left and right sides, further wherein said lower cone includes a slot extending radially outwardly of and along each side of each said inclined outer surface and each said lower slip includes at least one protrusion extending outwardly from its respective left and right sides, each said protrusion being captured and slideable within a corresponding said slot of said lower cone, wherein said slots are configured to retain said corresponding protrusions during and after movement of each said lower slip relative to said upper cone.

17. System for assisting in setting a downhole tool in a well bore, the system comprising:

the downhole tool including an elongated mandrel having upper and lower ends, an upper cone extending around said mandrel and having at least one inclined outer surface, at least one upper slip disposed at least partially between the upper end of said mandrel and said upper cone, said at least one upper slip being axially moveable relative to said mandrel, slideable over one of said inclined outer surfaces of said upper cone and engageable with the well bore wall, an upper ring disposed on said mandrel at least partially between the upper end of said mandrel and said at least one upper slip, said upper ring being axially movable relative to said mandrel and configured to be used to push at least one said upper slip at least partially along said associated inclined outer surface of said upper cone; and a setting tool being moveable with the downhole tool into the well bore and including at least one collet assembly coupled to said mandrel, said collet assembly including at least one locking mechanism engaged with said upper ring in a first position to prevent said upper ring from advancing said at least one upper slip along said associated inclined outer surface of said upper cone, said at least one locking mechanism being moveable from said first position into a second position that allows said upper ring to be used to push said at least one upper slip along said associated inclined outer surface of said upper cone, and at least one sleeve disposed radially outwardly of said collet assembly and being axially moveable relative to said mandrel and said collet assembly, said at least one sleeve being configured to move said at least one locking mechanism from said first position to said second position, said at least one sleeve also configured to move said upper ring in the direction of the lower end of said mandrel, causing said upper ring to push said at least one upper slip at least partially along said associated inclined outer surface of said upper cone, wherein said upper ring is at least temporarily engaged with at least one said upper slip in a manner that prevents axial movement of said at least one upper slip independent of axial movement of said upper ring prior to engagement of said at least one upper slip with the well bore wall, said upper ring including at least one slip pin engaged within a slip pin orifice formed in one of said upper slips and configured to prevent axial movement of said upper slip relative to said upper ring, said upper slip being configured to move radially outwardly relative to said upper ring over said at least one slip pin as said upper slip is pushed along said inclined outer surface of said upper cone.

18. Method of preventing the premature setting of upper slips of a downhole tool in a well bore prior to reaching the desired setting location in the well bore and assisting in setting the upper slips in the well bore with the use of a setting tool, the downhole tool having a main body and upper and lower ends, the setting tool having at least one locking mechanism and at least one sleeve, the method comprising:

engaging at least one locking mechanism of the setting tool with the upper slips, said at least one locking mechanism including at least one collet finger;

deploying the setting tool and downhole tool in tandem into the well bore;

positioning the downhole tool at the desired setting location;

moving the at least one locking mechanism radially inwardly out of engagement with the upper slips;

moving at least one sleeve of the setting tool in the direction of the lower end of the downhole tool to (i) bias the at least one collet finger radially inwardly out of engagement with the upper slips and (ii) push the upper slips into engagement with the B well bore wall.

19. The method of claim 18 wherein an upper ring is disposed around the main body of the downhole tool between the at least one locking mechanism and the upper slips, wherein the at least one locking mechanism releaseably engages the upper ring, further including at least temporarily engaging the upper ring with the upper slips, whereby the engagement of the at least one locking mechanism and the upper ring prevents the upper slips from prematurely engaging the well bore wall.

20. The method of claim 18 wherein the upper ring is disposed between the at least one sleeve and the upper slips, wherein when the at least one sleeve is moved in the direction of the lower end of the downhole tool, the at least one sleeve pushes the upper ring in the direction of the lower end of the downhole tool, causing the upper ring to push the upper slips into engagement with the well bore wall.

* * * * *

UNITED STATES PATENT AND TRADEMARK OFFICE

CERTIFICATE OF CORRECTION

PATENT NO. : 8,584,765 B2
APPLICATION NO. : 13/215478
DATED : November 19, 2013
INVENTOR(S) : Gabriel Antoniu Slup It is certified that error appears in the above-identified patent and that said Letters Patent is hereby corrected as shown below:

In the Claims:

In claim 18, Column 16, line 12, please replace -said- with the word "the".

In claim 18, Column 16, line 24, please delete "B".

Signed and Sealed this
Eleventh Day of February, 2014

Michelle K. Lee

Michelle K. Lee
*Deputy Director of the United States Patent and Trademark Office*